US010861413B2

(12) United States Patent
Ward et al.

(10) Patent No.: US 10,861,413 B2
(45) Date of Patent: Dec. 8, 2020

(54) SYSTEM AND METHOD FOR AGE-BASED GAMUT MAPPING

(71) Applicant: Faurecia Irystec Inc., Montréal (CA)

(72) Inventors: Greg Ward, Berkeley, CA (US); Tara Akhavan, Montréal (CA); Afsoon Soudi, Toronto (CA); Hyunjin Yoo, Montréal (CA)

(73) Assignee: Faurecia Irystec Inc., Montreal (CA)

( * ) Notice: Subject to any disclaimer, the term of this patent is extended or adjusted under 35 U.S.C. 154(b) by 0 days.

(21) Appl. No.: 16/347,871

(22) PCT Filed: Nov. 7, 2017

(86) PCT No.: PCT/CA2017/051321

§ 371 (c)(1),
(2) Date: May 7, 2019

(87) PCT Pub. No.: WO2018/081911

PCT Pub. Date: May 11, 2018

(65) Prior Publication Data

US 2019/0266977 A1 Aug. 29, 2019

Related U.S. Application Data

(60) Provisional application No. 62/418,361, filed on Nov. 7, 2016.

(51) Int. Cl.

| | |
|---|---|
| ***G09G 5/02*** | (2006.01) |
| ***G09G 3/3208*** | (2016.01) |
| ***G09G 5/04*** | (2006.01) |
| ***G09G 5/10*** | (2006.01) |
| ***G09G 5/06*** | (2006.01) |
| *G09G 3/3225* | (2016.01) |

(52) U.S. Cl.
CPC ..... *G09G 5/026* (2013.01); *G09G 3/3208* (2013.01); *G09G 5/02* (2013.01); *G09G 5/04* (2013.01);

(Continued)

(58) Field of Classification Search
CPC ..... G09G 5/026; G09G 5/06; G09G 5/02; G09G 5/10; G09G 5/04; G09G 3/3208;

(Continued)

(56) References Cited

U.S. PATENT DOCUMENTS 6,873,314 B1 * 3/2005 Campbell ..... A61B 3/113 345/156
2004/0156544 A1 * 8/2004 Kajihara ..... H04N 1/628 382/167

(Continued)

FOREIGN PATENT DOCUMENTS

EP 3155586 A2 4/2017
JP 2015173891 A 10/2015

OTHER PUBLICATIONS

Fairchild, M.D et al., Mean Observer Metamerism and the Selection of Display Primaries, Fifteenth Color Imaging Conference: Color Science and Engineering Systems, Technologies, and Applications, Albuquerque, New Mexico, Nov. 2007.

(Continued)

*Primary Examiner* — William A Beutel

(74) *Attorney, Agent, or Firm* — Occhiuti & Rohlicek LLP

(57) ABSTRACT

A method for processing an image for display on a wide-gamut display includes receiving a viewer's characteristic, determining a set of color scaling factors based on the characteristic, and applying the set of color scaling factors to adjust a white point of the image.

22 Claims, 13 Drawing Sheets

(52) U.S. Cl.
CPC ..... *G09G 5/06* (2013.01); *G09G 5/10* (2013.01); *G09G 3/3225* (2013.01); *G09G 2320/06* (2013.01); *G09G 2320/0606* (2013.01); *G09G 2320/068* (2013.01); *G09G 2320/0666* (2013.01); *G09G 2340/06* (2013.01); *G09G 2354/00* (2013.01); *G09G 2360/144* (2013.01)

(58) Field of Classification Search
CPC ... G09G 2320/0606; G09G 2320/0666; G09G 2354/00; G09G 3/3225; G09G 2320/06; G09G 2360/144; G09G 2320/068; G09G 2340/06
See application file for complete search history.

(56) References Cited

U.S. PATENT DOCUMENTS

| | | | | |
|---|---|---|---|---|
| 2004/0183828 | A1 | 9/2004 | Nichogi et al. | |
| 2008/0111819 | A1 | 5/2008 | Sung et al. | |
| 2011/0115811 | A1 | 5/2011 | Zhang et al. | |
| 2014/0240341 | A1* | 8/2014 | Oda | G09G 3/3406 345/590 |
| 2015/0077640 | A1* | 3/2015 | Kanda | H04N 9/3182 348/713 |
| 2015/0346987 | A1 | 12/2015 | Ren et al. | |

OTHER PUBLICATIONS

Fernandez, S. et al., Observer preferences and cultural differences in color reproduction of scenic images, ID&T/SID 10th Color Imaging Conference, Scottsdale, 66-72, 2002.
Langner, O. et al., Ad (2010), Presentation and validation of the Radboud Faces Database, Cognition & Emotion, 24: 8, 2010.
Varian, H. Bootstrap tutorial., Mathematica Journal, vol. 9, No. 4, pp. 768-775, 2005.
Stockman, A. et al., Physiologically-based colour matching functions, Proc. ISCC/CIE Expert Symp. 06, CIE Pub. x030:2006, 13-20, 2006.
Written Opinion issued for international patent application No. PCT/CA2017/051321, Publication No. WO 2018/081911, dated Feb. 6, 2018.
Laird, J. et al., Development and Evaluation of Gamut Extension Algorithms, Color Research & Application, 34:6, 2008.
Song, G. et al., Skin Color Region Protect Algorithm for Color Gamut Extension, Journal of Information & Computational Science, 11:6, pp. 1909-1916, 2014.
Zamir, S.W. et al., Gamut Extension for Cinema: Psychophysical Evaluation of the State of the Art, and a New Algorithm, Proc. SPIE Human Vison and Electronic Imaging XX, 2015.
Zamir, S.W. et al., Gamut Mapping in Cinematography Through Perceptually-Based Contrast Modification, IEEE Journal of Selected Topics in Signal Processing, 8:3, Jun. 2014.
Vazquez-Corral J. et al., Perceptually inspired gamut mapping between any gamuts with any intersection, AIC Midterm Meeting, 2015.
Eilertsen G. et al., Evaluation of tone mapping operators for hdr-video,Computer Graphics Forum, vol. 32, No. 7, pp. 275-284, Wiley Online Library, 2013.
Wanat, R. et al., Simulating and compensating changes in appearance between day and night vision, ACM Trans. Graph., vol. 33, No. 4, 147-1, 2014.
Rezagholizadeh M. et al., A Retargeting Approach for Mesopic Vision: Simulation and Compensation, Journal of Imaging Science and Technology, 2015.
Silverstein D.A et al., Efficient method for paired comparison, Journal of Electronic Imaging, vol. 10, No. 2, pp. 394-398, 2001.

* cited by examiner

SYSTEM AND METHOD FOR AGE-BASED GAMUT MAPPING

CROSS REFERENCE TO RELATED APPLICATIONS

This application is a National Stage of International Application No. PCT/CA2017/051321 filed on Nov. 7, 2017, which claims priority to U.S. Provisional Application No. 62/418,361 filed on Nov. 7, 2016.

TECHNICAL FIELD

The technical field generally relates to processing of images for displaying onto a wide-gamut display device.

BACKGROUND

Colorimetry is based on the assumption that everyone's color response can be quantified with the CIE standard observer functions, which predict the average viewer's response to the spectral content of light. However, individual observers may have slightly different response functions, which may cause disagreement about which colors match and which do not. For colors with smoothly varying (broad) spectra, the disagreement is generally small, but for colors mixed using a few narrow-band spectral peaks, differences can be as large as 10 CIELAB units [Fairchild & Wyble 2007]. (Anything greater than 5 CIELAB units is highly salient.)

Wide-gamut displays, such as organic light-emitting diodes (OLEDs), can amplify this problematic situation. This makes it difficult for observers to agree on what constitutes white on narrow-band displays such as Samsung's popular AMOLED devices. Observer metamerism is likely to occur more frequently with wide color gamut.

SUMMARY OF THE INVENTION

According to one aspect, there is provided a method for processing an input image for display on a wide-gamut display device. The method includes receiving an age-related characteristic of a user viewing the wide-gamut display device, determining a set of color scaling factors based on the age-related characteristic of the user and the gamut of the wide-gamut display device, applying gamut expansion to the input image to generate a gamut-expanded image, and applying the set of color scaling factors to the gamut expanded image to adjust a white point thereof.

According to another aspect, there is provided a method for processing an input image for display on a wide-gamut display device. The method includes receiving an age-related characteristic of a user viewing the wide-gamut display device, receiving a color temperature setting, determining a black body spectrum corresponding to the received color temperature setting; determining a first set of LMS cone responses corresponding to the black body spectrum based on the age-related characteristic of the user, determining a second set of LMS cone responses based on a primary spectra of the wide gamut display device and determining a set of color scaling factors providing a correspondence between the first set of LMS cone responses and the second set of LMS cone responses, the set of color scaling factors being effective for adjusting a white balance of the input image.

According to yet another aspect, there is provided a method for processing an input image for display on a wide-gamut display device, the input image being represented in a first color space. The method includes for each image pixel of a plurality of pixels of the input image converting color value components of the image pixel in the first color space to a corresponding set of chromaticity coordinates in a chromaticity coordinate space, defining a sacred region within the chromaticity coordinate space, determining whether the set of chromaticity coordinates of the image pixel is located within the sacred region, and determining a set of mapped color value components of the image pixel based on:

- if the chromaticity coordinates of the image pixel is located within the sacred region, applying a first mapping of the color value components of the image pixel; and
- if the chromaticity coordinates of the image pixel is located outside the sacred region, applying a second mapping of the color value components of the image pixel.

According to yet another aspect, there is provided a method for displaying graphical content within an application running on an electronic device having a display device. The method includes receiving by the application said graphical content to be displayed by the application from a provider of the graphical content, receiving an user-related characteristic of a user using the application on the electronic device, processing the graphical content based on the user-related characteristic of the user to generate user-targeted graphical content, displaying via the application the user-targeted graphical content, and detecting by the application an interaction of the user with the displayed user-targeted graphical content.

According to various aspects, a computer-implemented system includes at least one data storage device; and at least one processor operably coupled to the at least one storage device, the at least one processor being configured for performing the methods described herein according to various aspects.

According to various aspects, a computer-readable storage medium includes computer executable instructions for performing the methods described herein according to various aspects.

BRIEF DESCRIPTION OF THE DRAWINGS

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

DETAILED DESCRIPTION

Figure 1:
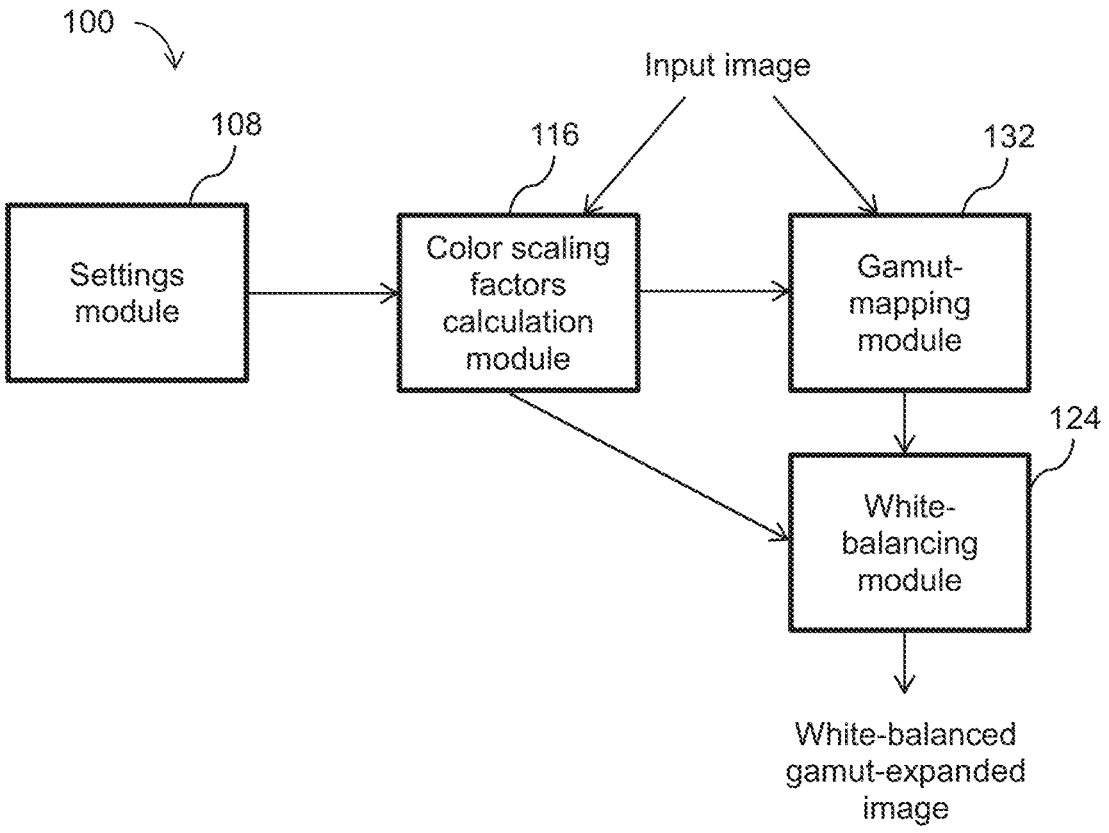
FIG. 1 illustrates a schematic diagram of the operational modules of a system for white balancing/gamut expansion.

Broadly described, various example embodiments described herein provide for processing of an input image, which may be represented in a standard color space, according to a user-related characteristic, such as age, so as to display the image, for example, on a wide-gamut display device.

One or more gamut mapping systems described herein may be implemented in computer programs executing on programmable computers, each comprising at least one processor, a data storage system (including volatile and non-volatile memory and/or storage elements), at least one input device, and at least one output device. For example, and without limitation, the programmable computer may be a programmable logic unit, a mainframe computer, server, and personal computer, cloud based program or system, laptop, personal data assistance, cellular telephone, smartphone, wearable device, tablet device, virtual reality devices, smart display devices (ex: Smart TVs), set-top box, video game console, or portable video game devices.

Each program is preferably implemented in a high level procedural or object oriented programming and/or scripting language to communicate with a computer system. However, the programs can be implemented in assembly or machine language, if desired. In any case, the language may be a compiled or interpreted language. Each such computer program is preferably stored on a storage media or a device readable by a general or special purpose programmable computer for configuring and operating the computer when the storage media or device is read by the computer to perform the procedures described herein. In some embodiments, the systems may be embedded within an operating system running on the programmable computer. In other example embodiments, the system may be implemented in hardware, such as within a video card.

Furthermore, the systems, processes and methods of the described embodiments are capable of being distributed in a computer program product comprising a computer readable medium that bears computer-usable instructions for one or more processors. The medium may be provided in various forms including one or more diskettes, compact disks, tapes, chips, wireline transmissions, satellite transmissions, internet transmission or downloadings, magnetic and electronic storage media, digital and analog signals, and the like. The computer-usable instructions may also be in various forms including compiled and non-compiled code.

A challenge is to provide the best viewer experience on wide-gamut display devices by customizing the color mapping to account for individual preference and physiological traits. Despite the predominant use of the sRGB standard color space, which has a rather limited gamut, images in such color space should be processed in a way that takes advantage of the additional gamut provided by wide-gamut display devices.

"Input image" herein refers to an image that is to be processed for display onto a wide-gamut display device. The input image is typically represented in a color space having a gamut that is narrower than the gamut of the wide-gamut display device. For example, the input image is represented in standard color space.

"Standard color space" herein refers to the sRGB color space or a color space having a gamut having approximately the same size as the gamut of sRGB.

"Wide-gamut display device" herein refers to an electronic display device configured to display colors within a gamut that is substantially greater than the standard color space. Examples of wide-gamut display devices include OLED display, quantum dot display and laser projectors.

Referring now to FIG. 1, therein illustrated is a schematic diagram of the operational modules of a system 100 for white balancing/gamut expansion according to various exemplary embodiments.

The white balancing/gamut-expansion system 100 includes a settings module 108 for receiving settings relevant to white balancing and/or gamut-expanding a received input image.

The settings module 108 may receive the relevant settings from a calibration environment intended to capture entry of user-related settings. The settings module 108 may also receive relevant settings already stored at a user device (ex: computer, tablet, smartphone, handheld console) that is connected to or has embedded thereto the wide-gamut display device. The settings module 108 may further receive relevant settings from an external device over a suitable network (ex: internet, cloud-based network). The external device may belong to a third party that has stored information about a user. The third party may be an external email account or social media platform.

The white balancing/gamut-expansion system 100 also includes a color scaling factors calculation module 116. The color scaling factors calculation module 116 receives one or more user-related settings from the settings module 108 and determines color scaling factors that are effective to apply white balancing within processing of the input image.

The color scaling factors calculation module 116 operates in combination with the white balancing module 124, which receives the calculated color scaling factors and applies the color scaling factors to cause white balancing (ex: shifting of white point).

The white balancing/gamut-expansion system 100 further includes a gamut-mapping module 132. The gamut-mapping module 132 is operable to map an image represented in a standard color space (ex: RGB, sRGB) to a color space having a wider gamut.

An output of the white balancing/gamut-expansion system 100 is a white-balanced, gamut-expanded image. The white-balancing and/or gamut expansion of the input image may be performed according to settings received by the settings module 108. It will be understood that gamut-mapping and gamut-expansion, and variants thereof are used interchangeably herein to refer to a process of mapping the colors of an input image represented in one color space to another color space.

Figure 2:
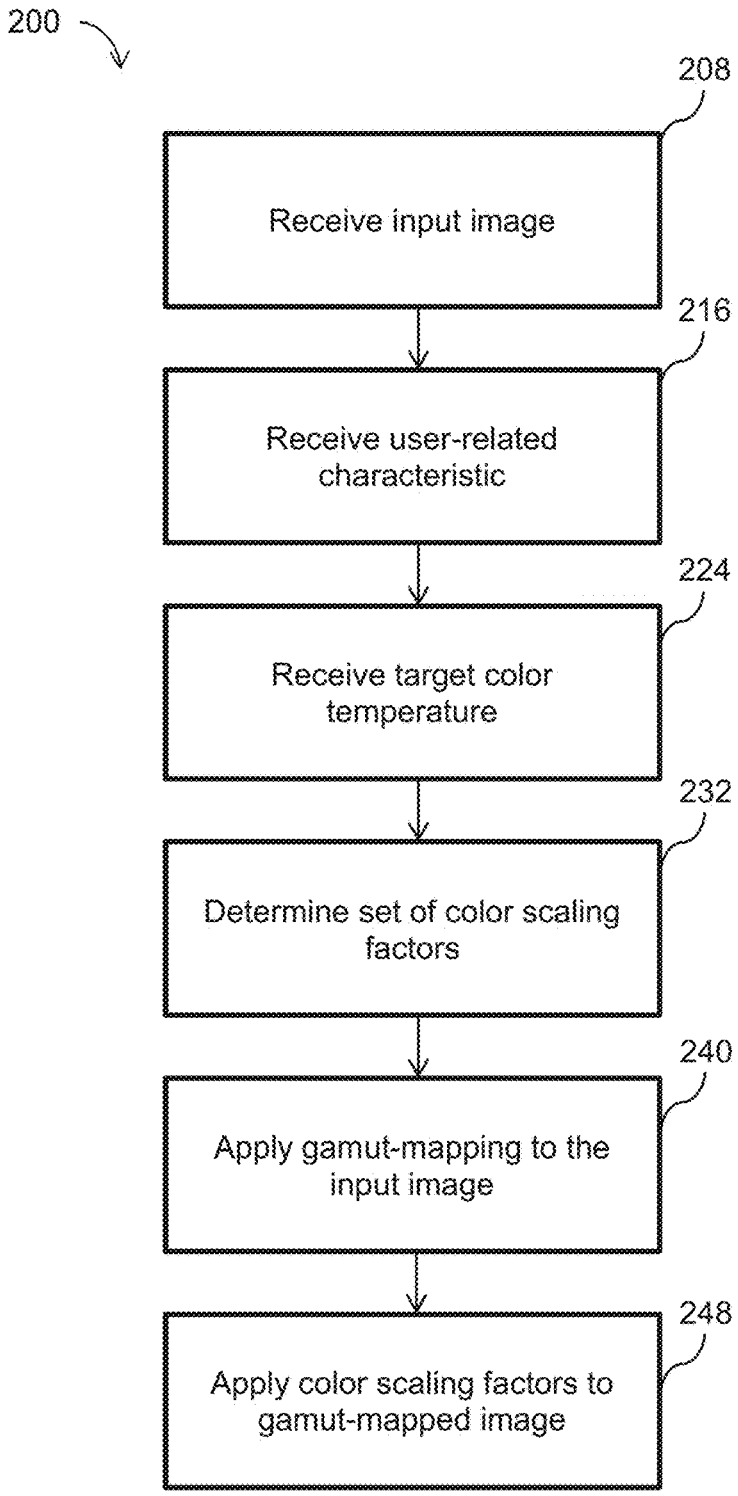
FIG. 2 illustrates a flowchart of the operational steps of an exemplary method for processing an input image for display on a wide-gamut display device.

Referring now to FIG. 2, therein illustrated is a flowchart of the operational steps of an exemplary method 200 for processing an input image for display on a wide-gamut display device. The gamut of the wide-gamut display device may be known. Furthermore, the identity and/or characteristics of the user viewing the wide-gamut display device may also be known.

At step 208, an input image to be processed is received. As described elsewhere herein, the input image is represented in a color space that is narrower than available gamut of a wide-gamut display device. The processing of the input image seeks to alter the colors of the input image so that its color space covers a larger area of the gamut of the wide-gamut display device.

At step 216, one or more user-related characteristics of the user is received. The user-related characteristics refer to characteristics that may affect how the user perceives colors.

The user-related characteristics may include an age-related characteristic, such as the user's actual age, the user's age group, user's properties, preferences or activities (ex: browsing history) that may indicate an age of user, or a user-selected setting that corresponds to an effective age of the user. The user's age-related characteristic may be obtained from user details stored on the user-operated device that includes the wide-gamut display device. The user's age-related characteristics may be obtained from user accounts associated to the user, such as user information provided to an online service (ex: email account, third party platform, social media service).

In one example, a calibration/training phase may be carried out in which calibration images (ex: image of human faces) and a graphical control element are displayed to the user. Interaction of the graphical control element (ex: a slider) allows the user to select an effective age setting and the calibration images are adjusted according to how a typical user of that effective age would perceive the image. The user can then lock in a preferred setting, which becomes the effective age for that user. Accordingly, the age-related characteristic is a user-entered parameter.

In one example, the graphical control element is a slider and as the slider being controlled and the calibration images are being adjusted, the current effective age corresponding to the position of the slider is hidden from the user and not explicitly displayed. Accordingly, the user will not be influenced to choose an effective age that corresponds to the user's actual age. Sliders may also be used to let a user select other viewing characteristics, such as level of detail, color temperature and contrast.

Other user-related characteristics that affect user perception may include color-blindness of the user and ethnicity of the user.

At step 224, a color temperature setting is optionally received. The color temperature setting corresponds to a target color temperature for processing the input image. The color temperature setting may correspond to a preferred color temperature of the user. The color temperature setting may be entered by the user, for example, by selecting from a plurality of preset settings. The color temperature setting may be obtained from user-related properties, such as time of day or user location (users in different territories, such as different continents, typically have varying preferences for color temperatures).

In one example, a calibration/training phase may be carried out in which calibration images (ex: image of human faces) and a graphical control element are presented to the user so that the user can select a preferred color temperature. Interaction of the graphical control element (ex: a slider) allows the user to select an effective color temperature setting and the calibration images are adjusted according to the currently selected color temperature setting. The user can then lock in the preferred color temperature setting.

In one example, the effective age setting and the color temperature setting may be selected by the user within the same calibration/training environment in which the calibration images are displayed with two separate slides corresponding to the effective age setting and the color temperature setting respectively. The user can toggle both sliders to select a preferred effective age setting and color temperature setting to be used for processing the input image.

At step 232, a set of color scaling factors is determined based on the user-related characteristic, such as the age-related characteristic of the user, and based on the gamut of the wide-gamut display device. Determination of the set color scaling factors may also depend on the color temperature setting for the user. For example, the gamut of the wide-gamut display device may be represented by the primary spectra of the wide-gamut display device (i.e. the spectrum of each of the primary colors of the wide-gamut display device). The color scaling factors are effective for shifting the white point of an image.

At step 240, gamut-mapping is applied to the input image to generate a gamut-mapped image. The gamut mapping is applied based on the gamut of the wide-gamut display device.

At step 248, the color scaling factors are applied to shift the white point. In the illustrated example, the color scaling factors are applied to the input image after it has undergone gamut-mapping. Alternatively, the color scaling factors may be applied prior to the input image undergoing gamut-mapping.

A white-balanced, gamut-expanded version of the input image is outputted from the method and is ready for display on the wide-gamut display device of the electronic device being by the user.

Figure 3:
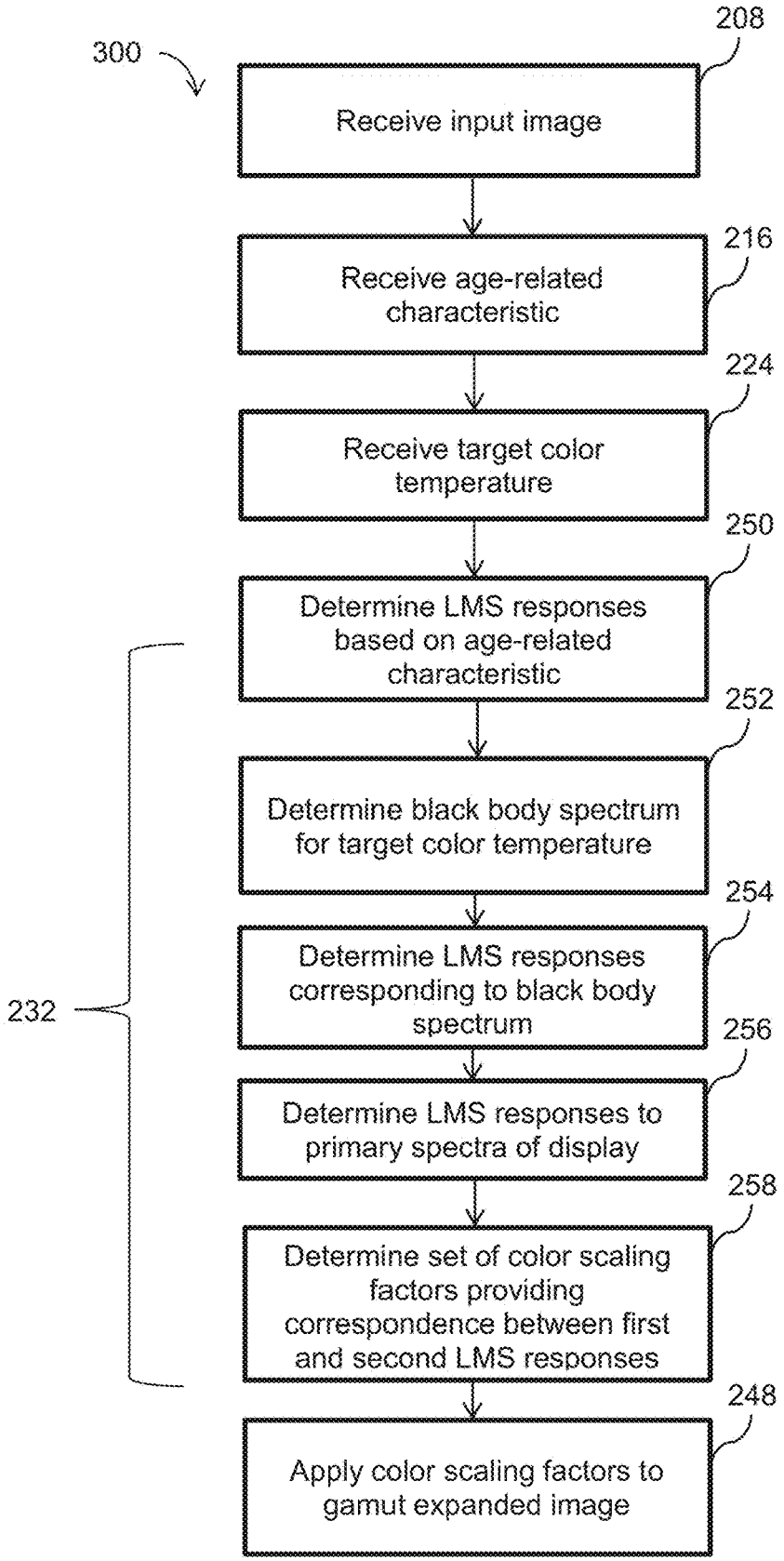
FIG. 3 illustrates a flowchart of the operational steps of an exemplary method for determining color scaling factors for shifting a white point.

Referring now to FIG. 3, therein illustrated is a flowchart of the operational steps of an exemplary method 300 for determining color scaling factors for shifting a white point within processing of an input image. The method 300 may be carried out as a stand-alone method. Alternatively, steps thereof may be carried out within the method 200 for processing an input image for display on a wide-gamut display device.

For example, step 208 of receiving an input image, step 216 of receiving one or more user-related characteristics of the user and step 224 of receiving target color temperature of method 300 are substantially the same as the corresponding steps of method 200.

At step 250, the LMS cone responses for the age defined by the age-related characteristic are determined. The LMS cone responses may be determined based on known physiological model, such as the CIE-2006 physiological model [Stockman & Sharpe 2006].

At step 252, the black body spectrum for the received color temperature setting is determined.

At step 254, a first subset of age-based LMS cone responses to the black body spectrum is determined. This first subset of age-based LMS cone responses is determined using the set of LMS cone responses determined at step 250.

At step 256, a second subset of age-based LMS cone responses to the primary spectra of the wide-gamut display device is determined. This second subset of age-based LMS cone responses is also determined using the set of LMS cone responses determined at step 250.

At step 258, a set of color scaling factors that provides a correspondence between the first subset of LMS cone responses and the second subset of LMS cone responses is determined. The set of color scaling factors is effective for adjusting a white balance of an image, such as the white balance of an input image that has undergone gamut expansion.

The combination of steps 250 to 258 may represent substeps of step 232 of determining the set of color scaling factors of method 200.

It will be appreciated that the set of color scaling factors are determined taking into account LMS cone responses for the age defined by the age-related characteristic of the user. Accordingly, age-based white balancing is carried out. In other examples, the LMS cone responses may be determined taking into account LMS cone responses for another user-related characteristic, such as color-blindness and/or ethnicity.

According to various example embodiments, the method 300 of determining color scaling factors further includes balancing the primary spectra of the wide gamut display device according to a current white point (ex: white balancing setting) of the wide gamut display device. Furthermore, the second set of LMS cone responses may be determined based on the balanced primary spectra.

Balancing the primary spectra of the wide gamut display device includes measuring the actual output of the wide gamut display device to determine the actual white point of the display device. The primary spectra for the display device is then adjusted according to that white point for the purposes of determine the set of color scaling factors.

According to various example embodiments, the method 300 may further comprise normalizing the set of color scaling factors.

Figure 4:
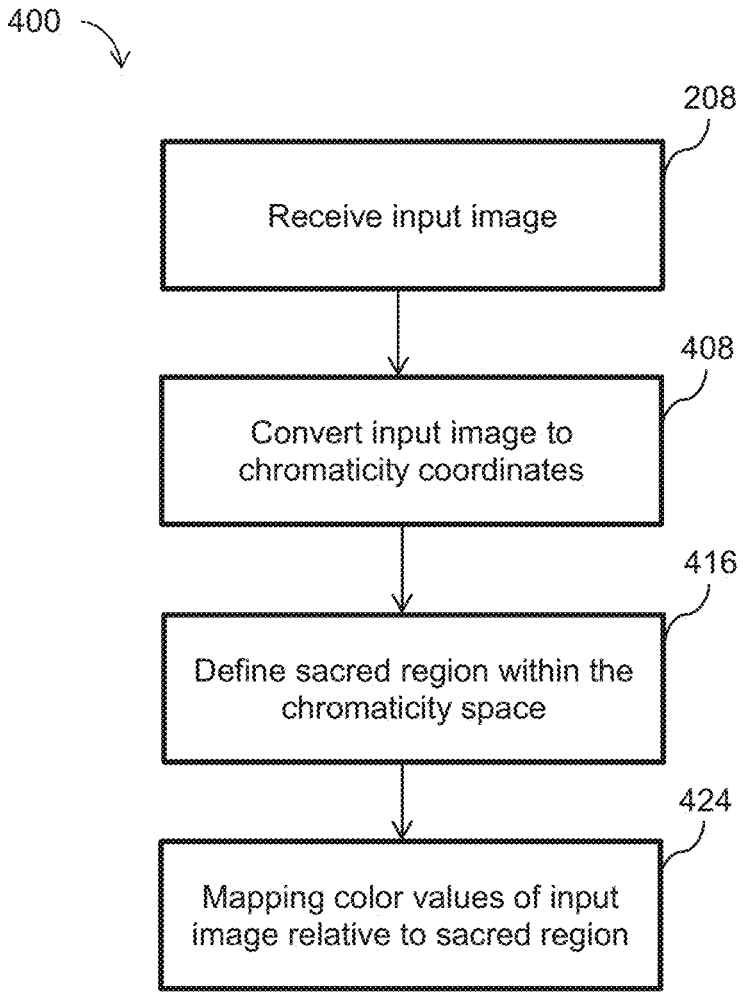
FIG. 4 illustrates a flowchart of the operational steps of an example method for applying gamut-mapping to an input image.

Referring now to FIG. 4, therein illustrated is a flowchart of the operational steps of an exemplary method 400 for applying gamut mapping to an input image within processing of the input image. The method 400 may be carried out as a stand-alone method. Alternatively, steps thereof may be carried out within the method 300 for processing an input image for display on a wide-gamut display device.

At step 408, the color value components of pixels of the input image are converted to a chromaticity coordinate space.

At step 416, a sacred region is defined within the chromaticity coordinate space. As described further herein, the boundaries of the sacred region define how a set of color value components within the first color space of the input image will be mapped.

"Sacred region" herein refers to a region corresponding to colors that should remain unshifted or be shifted less than other colors during gamut-mapping because shifting of such colors has a higher likelihood of being perceived by a human observer as being unnatural. For example, colors falling within the sacred region may include neutral colors, earth tones and flesh tones.

At step 424, the color values of the input image are mapped according to the relative location of a set of color value components in the chromaticity space relative to the sacred region.

According to one example embodiment, for a given set of color value components, if the chromaticity coordinates corresponding to the set of color value components of the input image is located within the sacred region, a first mapping of the color value components is applied. If the chromaticity coordinates corresponding to the given set of color value components is located outside of the sacred region, a second mapping of the color value components is applied.

In one example, the input image is represented in a first color space and the wide-gamut display device is configured to display images in a second color space that is different than the first color space. A given set of color value components of the input image is converted to a corresponding set of color value components in a second color space. If the chromaticity coordinates corresponding to the given set of color value components of the input image falls within the sacred region, the first mapping is applied in which the set of color value components converted into the second color space of the wide-gamut display device is set as the output color value components of the gamut-mapped output image.

In one example, if the chromaticity coordinates of a given set of color value components is located outside the sacred region, the second mapping is applied based on a distance between the chromaticity coordinates and an edge of the sacred region. The second mapping is further based on a distance between the chromaticity coordinates and an outer boundary of the second color space defining the spectrum of the wide-gamut display device. The outer boundary of the second color space corresponds to the chromaticity coordinates of the primaries of the wide-gamut display device.

A linear interpolation between the color value components in the first color space and the color value components in the second color space may be applied. The linear interpolation may be based on a ratio of the two distances calculated.

It will be understood that method 400 may be carried out on a pixel by pixel basis for the input image, wherein the steps of method 400 are repeated for each image pixel. That is, the color value components of a given pixel are converted to the chromaticity space and the mapping is carried to determine the color value components in the second color space for the specific pixel. It will be further understood that the sacred region may be defined in the chromaticity space prior to gamut-mapping each of the pixels of the input image.

Figure 5:
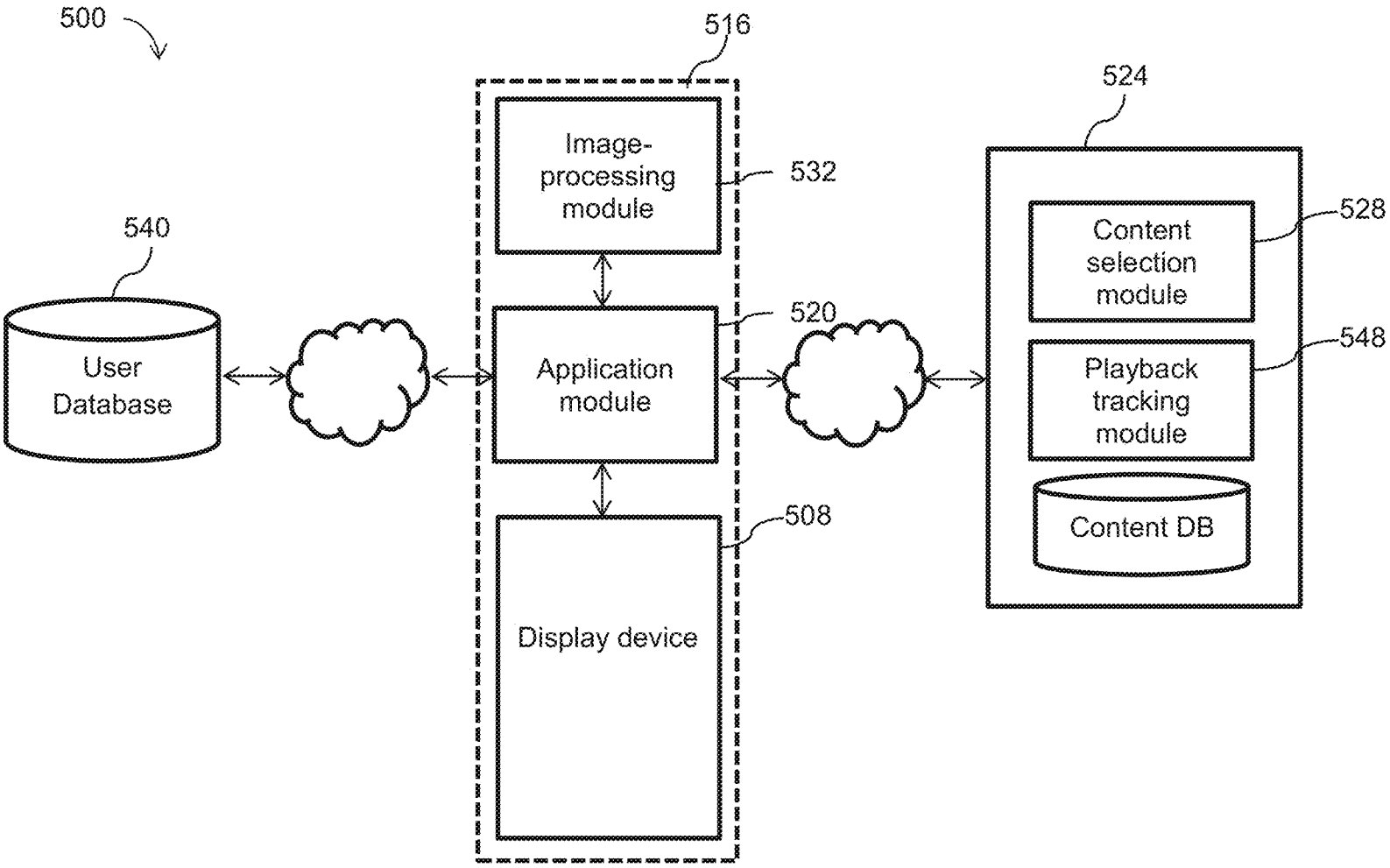
FIG. 5 illustrates a system for user-adapted display of graphical content from a content provider.

Referring now to FIG. 5, therein illustrated is a system 500 for displaying standard color space content on a display device 508 of a user device 516 (ex: computer, tablet, smartphone, handheld console) currently being used by a user. The user device 516 is configured to execute a computer program 520 in which various graphical content is to be displayed on the wide-gamut display device 508. The computer program may be an application or "app" executing in a particular environment, such as within an operating system. Alternatively, the computer program may be an embedded feature of the operating system.

The graphical content may be generated by a content generating party 524. The graphical content may be one or more images and/or videos. The content generating party 524 is in communication with the user device 516 running the computer program over a suitable network, such as the Internet, WAN or cloud-based network. The content generating party 524 may include a content selection module 528 that selects the graphical content to be displayed by the computer program. The content selection module 528 may receive from the computer program 520 information about the user (ex: user profile, user history, etc.) and generate content-adapted to the user profile.

The selected graphical content is received at the computer program 520. However, where the graphical content is in standard color space, the display of the graphical content may not be suitably adapted to the user viewing that content via the display device 508. The received graphical content is processed by an image processing module 532 implemented within the user device 516 to generate a processed graphical content adapted to the user.

For example, the image processing may include gamut-mapping the graphical content for display on wide-gamut display device according to method described herein. Additionally, or alternatively, the gamut-mapping may include white-balancing, contrast adjustment, tone-mapping, adjustment for color blindness, sensitivity adjustment, limiting brightness, etc.

The image processing module 516 is configured to receive a user-related characteristic of the user using the electronic device 516. The user-related characteristic of the user may be stored on the electronic device 516. Alternatively, the user-related characteristic of the user may be received from a third party provider 540, such as over a suitable communication network. The third party provider 540 may be an email account or social media platform that has an account associated to the user. Account information or use of the social media platform can include user-related characteristics of the user.

The image processing module 532 is configured to receive an user-related characteristic of the user using the electronic device 516. The user-related characteristic of the user may be stored on the electronic device 516.

Based on the user-related characteristics of the user, the image processing module 532 performs processing of the graphical content. Additionally, or alternatively, the image processing module 532 may perform the processing of the graphical content based on ambient viewing characteristics and/or device-related characteristics. The image processing module 532 may perform processing methods developed by Irystec Inc. that improve user perception of the graphical content. These processing methods may include the gamut-mapping described herein according to various example embodiments, adjusting for ambient lighting conditions (ex: luminance retargeting, contrast adjustment, color retargeting transforming an image according to peak luminance of a display), video tone mapping, etc. Image processing techniques may include methods described in PCT application no. PCT/GB2015/051728 entitled "IMPROVEMENTS IN AND RELATING TO THE DISPLAY OF IMAGES"; PCT application no. PCT/CA2016/050565 entitled "SYSTEM AND METHOD FOR COLOR RETARGETING"; PCT application no. PCT/CA2016/051043 entitled "SYSTEM AND METHOD FOR REAL-TIME TONE-MAPPING", U.S. provisional application No. 62/436,667 entitled "SYSTEM AND METHOD FOR COMPENSATION OF REFLECTION ON A DISPLAY DEVICE", all of which are incorporated herein by reference.

Ambient viewing characteristics refer to characteristics defining the ambient conditions present within the environment surrounding the electronic device 516 and which may affect the experience of the viewer. Such ambient viewing characteristics may include level of ambient lighting (ex: bright environment vs dark environment), presence of a light sources causing reflections on the display device, etc. The ambient viewing characteristics can be obtained using various sensors of the electronic device, such as GPS, ambient light sensor, camera(s), etc.

Device-related characteristics refer to characteristics defining capabilities of the electronic device 516 and which may affect the experience of the viewer. Such device-related characteristics may include resolution of the display device 508, type of the display device 508 (ex: LCD, LED, OLED, VR display, etc.), gamut of the display, processing power of the electronic device 516, current workload of the electronic device 516, peak luminance of the display, current mode of the display (ex: power saving mode) etc.

The gamut-mapped graphical content is passed to the computer program 520 and the program 524 causes the processed graphical content 536 to be displayed on the display device 508 of the user electronic device.

One of the image processing module 532 and the computer program 520 may further transmit to the content generating party 524 a message indicating that the graphical content was gamut-mapped prior to being displayed on the display device 508 of the user device 516.

In some example embodiments, the graphical content may be an interactive element, such as advertising content. The computer program 520 monitors the graphical content to detect user interaction with the graphical content (ex: selecting, clicking, scrolling to, sharing, viewing by user) and transmits a message indicating the gamut-mapped graphical content was interacted with by the user.

The content generator 524 may further include a playback tracking module 548 that tracks the amount of times a graphical content was processed by the image-processing module and/or the amount of times the processed graphical content was interacted with.

The image processing module 532 may be implemented separately from the computer program 520 being used by the user. Alternatively, the image processing module 532 is embedded within the computer program 520.

In some example embodiments, the image processing module 532 may be implemented within the content generator 524. Accordingly, the content generator 524 receives user-related characteristics, ambient viewing characteristics and/or device-related characteristics from the electronic device 516 and processes the selected content based on these characteristics prior to transmitting the content to the electronic display 516 for display.

For example, the user-related characteristic is a perception-related characteristic, such an age-related characteristic of the user and the image processing includes white/balancing and gamut-mapping according to various examples described herein.

It will be appreciated that the image processing module 532 causes the graphical content to be further processed so as to improve viewer perception of the graphical content.

Furthermore, the processing is personalized to one or more specific characteristics of the user that directly influence viewer perception.

Figure 6:
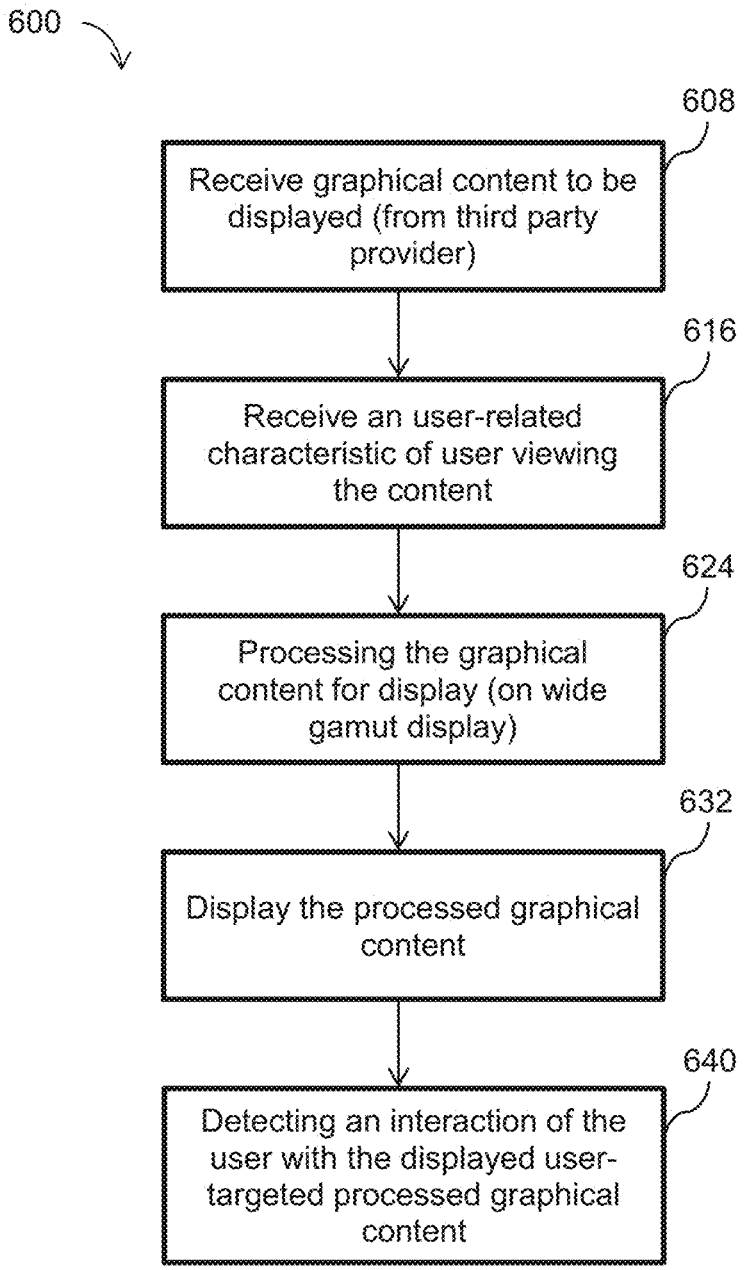
FIG. 6 illustrates a flowchart of the operational steps of a method for user-adapted display of graphical content from a content provider.

Referring now to FIG. 6, therein illustrates is a flowchart of the operational steps of an example method 600 for user-adapted display of graphical content from a content provider.

At step 608, the graphical content to be displayed is received, such as from the third party content provider.

At step 616, user-related characteristic is received. Ambient viewing characteristics and/or device-related characteristics may also be received.

At step 624, the graphical content is processed for display based on the received user-related characteristic, ambient-viewing characteristics and/or device-related characteristics.

At step 632, the processed graphical content is displayed to the user.

At step 640, interaction of the processed graphical content is monitored and detected. One or more notifications may be further transmitted to indicate such interactions. The interaction of the user with the electronic device displaying the processed graphical content may be monitored and detected by the electronic device and the notification is transmitted to the content generating party 524 or a third party. The notification provides an indicator of the selected graphical content that was displayed, that the graphical content had been processed for improved perception, and that the processed content had been interacted with.

For example, the graphical content can be an advertising content and processing the graphical content seeks to attract the attention of the user. The notification indicates a "click-through" by the user. The content generating party or third party receiving the notification tracks the number of interactions that occur. Such information pertaining to notifications may be used to determine an amount of compensation for the service of processing the graphical content.

In a real-life example, a user may be accessing content online such as via a website, mobile app, social media service, or content-streaming service. Graphical content, such as an advertisement is selected for user to be displayed with the content. For example, the party generating the online content can also select the advertisement to be displayed. The user-related characteristics, ambient viewing characteristics, and device-related characteristics can be obtained. The user-related characteristics can be obtained from user profile information stored on the electronic device or from one or more social media profiles for that user. The graphical content is then processed to improve perceptual viewing for the user and displayed with the online content. As the user is consuming the online content, the user's activities are monitored to detect if the user interacts with the processed graphical advertisement content. If the user interacts with the processed graphical advertisement content, a notification is emitted indicating that the graphical content was processed and that the user interacted with it.

Example Implementation

An example implementation includes a white balancing technique that allows for observer variation (metamerism) together with color temperature preference, and a gamut expansion technique that maps the sRGB input to the wider OLED gamut while preserving the accuracy of critical colors such as flesh tones.

The CIE 2006 model of age-based observer color-matching functions was employed, which establishes a method for computing LMS cone responses to spectral stimuli [Stockman & Sharpe 2006]. This model was used to discover the range of expected variation rather than predict responses from age alone. Differences in color temperature preference were also allowed, as it has been shown that some users prefer lower (redder) or higher (bluer) whites than the standard 6500° K [Fernandez & Fairchild 2002]. A user will be shown a set of faces on a neutral background and offered a 2-axis control to find their preferred white point setting, which corresponds to the age-related and color temperature-related dimensions. (Age variations tend along a curve from green to magenta, while color temperature varies from red to blue, so overall this provides ample variation.) The Radbound Faces Database [Langner et al. 2010] was used.

A common method to utilize the full OLED color gamut is to map RGB values directly to the display, which results in saturated but inaccurate colors. The precise mapping of sRGB to an OLED display using an appropriate 3×3 transform eliminates any benefit from the wider gamut, as it restricts the output to the input (sRGB) color range.

It was observed that accuracy is most important in the neutral and earth-tone regions of color space, where shifts and excessive saturation may be objectionable. Out towards the spectral locus, however, over-saturated colors may be desirable, since observers are less critical of variations in the saturation or even the hue of strong colors. Especially for naïve viewers, brilliant colors are frequently favored over accurate ones.

The example implementation seeks to preserve the accuracy of colors in an identified "sacred" region of color space, which is to be determined but will include all variations of flesh tones and commonly found earth tones. Outside this region, the mapping is gradually altered to where values along the sRGB gamut boundary map to values along the target OLED display's maximum gamut.

The example implementation takes a sRGB input image and maps it to an AMOLED display using a preferred white point, and maintaining accuracy in the neutrals while saturating the colors out towards the gamut boundaries. The details of the implementation and some example output are given below.

An important step in the implementation is to adjust the display white point to correspond to the viewer's age-related color response and preference. The two inputs are CIE-2006 observer age and black body temperature. As described, the two inputs may be obtained from a user given 2-dimensional control of control elements representing effective age and color temperature where the actual effective age value and color temperature is hidden from the user. From these parameters and detailed measurements of the OLED RGB spectra and default white balance, the white balance multipliers (color scaling factors) are calculated using the following procedure:

1. Balance OLED primary spectra so they sum to current display white point. (I.e., multiply against 1931 standard observer curves and solve for RGB scaling that achieve measured xy-chromaticity.) An arbitrary scale factor corresponding to maximum white luminance will remain, which does not matter in this context.
2. Determine the LMS cone responses for the given age based on the CIE-2006 physiological model.
3. Compute the black body spectrum for the specified target color temperature.
4. Compute the age-based LMS cone responses to this black body spectrum.
5. Compute the 3×3 matrix corresponding to the LMS cone responses to the OLED RGB primary spectra.

6. Solve the linear system to determine the RGB factors (again within a common luminance scaling) that achieve the desired black body color match.
7. Divide these white balance factors by the maximum of the three, such that the maximum factor is 1. These are the linear factors to be applied to each RGB pixel to map an image to the desired white point.

Note that there are two degrees of freedom on the input, age and color temperature, and two degrees of freedom in the output, since one of the RGB factors is always 1.0.

Figure 7:
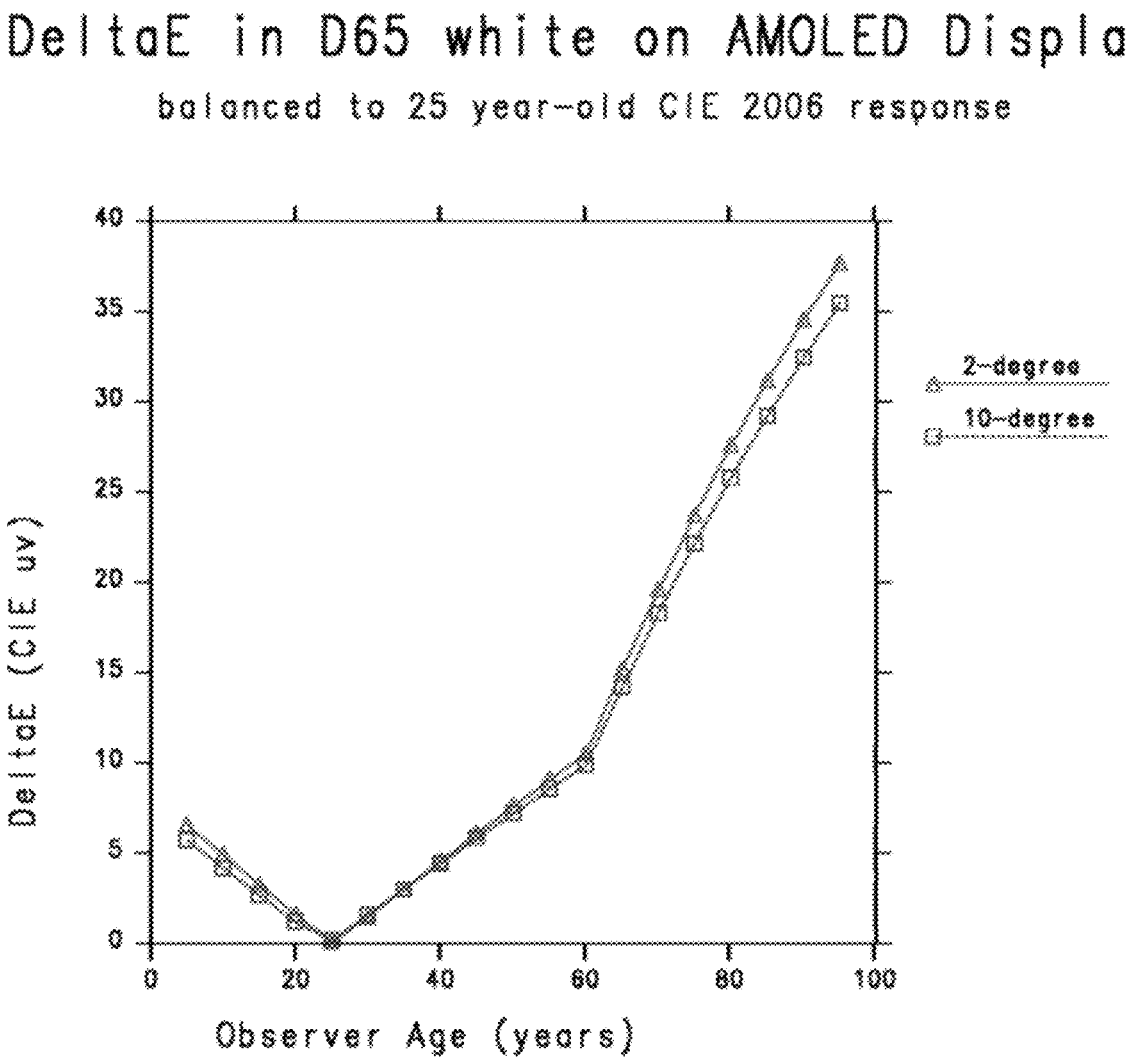
FIG. 7 illustrates the difference in D65 white appearance relative to a 25 year-old reference subject on a Samsung AMOLED display (Galaxy Tab) for 2 degree and 10 degree patches.

FIG. 7 illustrates the difference in D65 white appearance relative to a 25 year-old reference subject on a Samsung AMOLED display (Galaxy Tab) for 2 degree and 10 degree patches.

For gamut-mapping, it is assumed that information about the larger gamut has been lost in the capture or creation of the sRGB input image, thus the correct representation cannot be deduced to fully utilize the wide-gamut display device's full color range. Rather than maintaining the smaller sRGB gamut on the wider gamut of the wide-gamut display device, gamut-mapping seeks to expand into a larger gamut in a perceptually preferred manner.

The example implementation seeks a gamut-mapping that is straightforward, while achieving the following goals:

1) Unsaturated colors in the critical region of color space, i.e., earth- and flesh-tones, must be untouched (i.e, colorimetric).
2) The most saturated colors possible in sRGB should map to the most saturated colors in the destination gamut, achieving an injective function (one-to-one mapping) between gamut volumes.
3) Luminance and the associated contrast should be preserved.

The gamut-mapping according to the example implementation starts by defining a region in color space where the mapping will be strictly colorimetric, and assume this is wholly contained within both source and destination gamuts. This region corresponds to the sacred region, which is defined as a point in CIE (u',v') color space and a radial function surrounding it. For the example implementation, a central position of (u',v')=(0.217,0.483) with a constant radius of 0.051 based on empirical measurements of natural tones. (This center might be further tuned or adjusted, and a more sophisticated radial function employed in future.)

The injective gamut-mapping function is defined as follows. For colors falling inside the defined sacred region, values are mapped colorimetrically (TCM), reproducing them as closely as possible to the original sRGB values on the target wide-gamut display device. This linear 3×3 mapping matrix is called $M_d$. Thus:

$$RGB_d^T = M_d RGB_i^T$$

where:

$RGB_i$=linearized input values in CCIR-709 primaries $RGB_d$=linear colorimetric display drive values The white point may be transformed as well by the above matrix to match the source white point to that of the display. Linearized input colors are mapped to CIE XYZ using the matrix $M_x$ then to (u',v') using the following standard formulae:

$$XYZ_i^T = M_x RGB_i^T$$

$$u' = 4X/(X+15Y+3Z)$$

$$v' = 9Y/(X+15Y+3Z)$$

-continued $$\text{where: } M_x = \begin{bmatrix} 0.497 & 0.339 & 0.164 \\ 0.256 & 0.678 & 0.066 \\ 0.023 & 0.113 & 0.864 \end{bmatrix}$$

(The $M_x$ matrix deliberately leaves off the D65 white point conversion, since the viewer is adapted to display white and the center of the sacred region should be maintained.)

For input colors outside the sacred region, the example implementation interpolates between the colorimetric mapping above and an SDS mapping that sends the original $RGB_i$ values to the display, applying linearity ("gamma") correction to each channel as needed.

Figure 8:
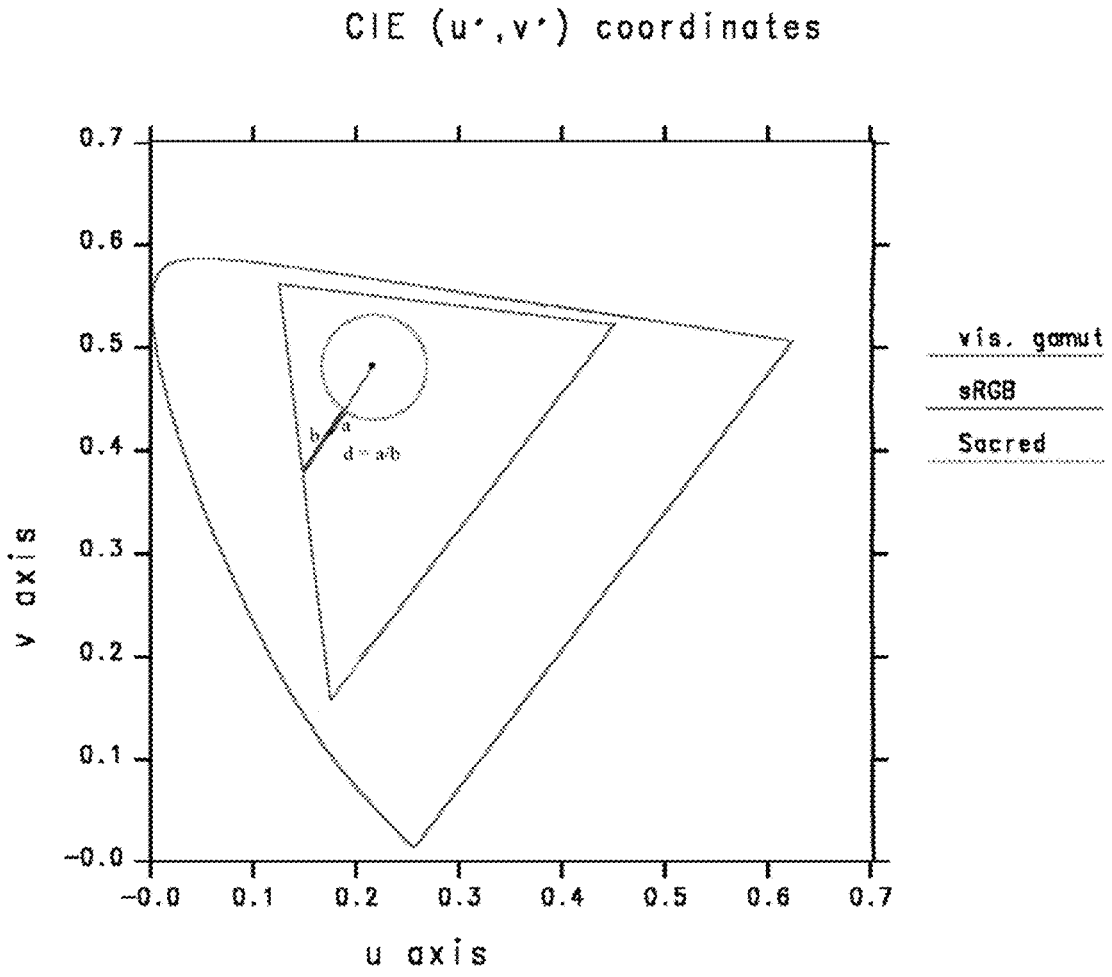
FIG. 8 illustrates the sacred region (green) with a line drawn from center through input color to sRGB gamut boundary in chromaticity space.

FIG. 8 shows the sacred region (green) with line drawn from center through input color to sRGB gamut boundary. The sacred region is shown in green, and the red line drawn from the center to the sRGB gamut boundary represents an approximation to constant hue. The distance a is how far the input color is from the edge of the sacred region in (u',v') coordinates. The distance b is the distance from the edge of the sacred region to the sRGB gamut boundary along that hue line. The value d is the ratio of a/b. The linear drive value is then computed as:

$$RGB_o = (1-d^2)\cdot RGB_d + d^2\cdot RGB_i$$

It was observed that a power of d was preferred over the more commonly used linear interpolant, although the results were not overly sensitive to the acceleration factor. This differs from previous blending factors for HCM, which apply a linear ramp keyed on saturation rather than distance between a sacred region and the gamut boundary. The power function provides functional continuity and better preserves "almost sacred" colors.

Figure 9:
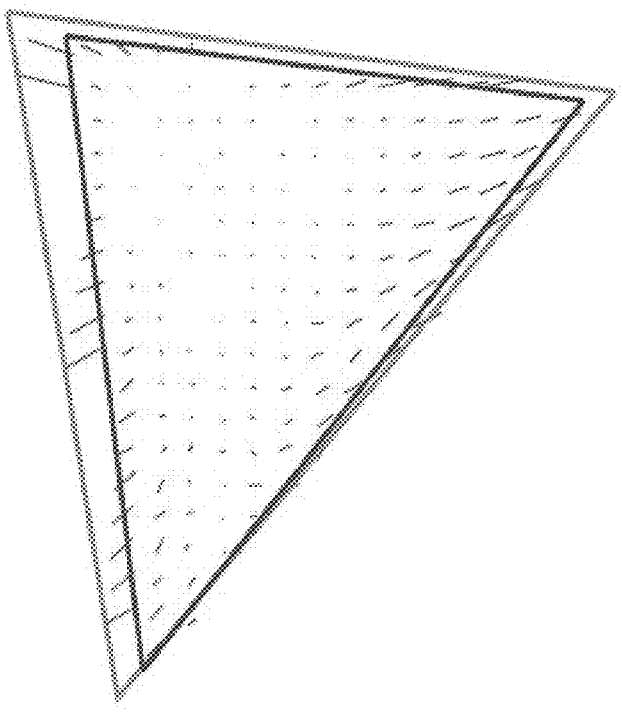
FIG. 9 illustrates a mapping from an sRGB gamut to AMOLED primaries showing example color motions using the example implementation described herein.
Figure 10:
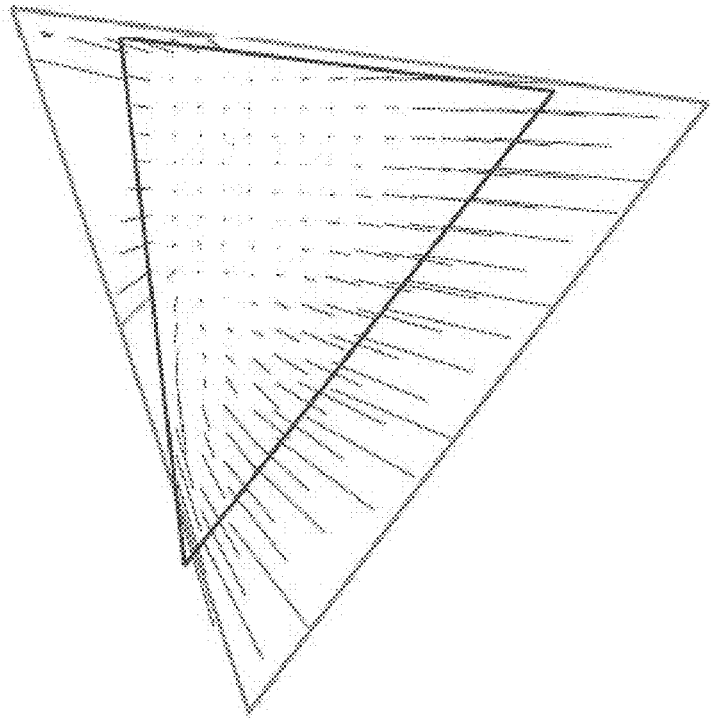
FIG. 10 illustrates a mapping from an sRGB gamut to laser primaries showing example color motions using the example implementation described herein.

The effect of this mapping on a regular array of (u',v') chromaticity coordinates is shown in FIG. 9, where sRGB is mapped to a particular set of AMOLED primaries. Note that there is little to no motion in the central portion defined as the sacred region. Even in the more extreme case of the laser primaries shown in FIG. 10, neutral colors are mapped colorimetrically. However, more saturated colors are expanded out towards the enlarged gamut boundary, even rotating hue as necessary to reach the primary corners. One hypothesis is that observers are less sensitive to color shifts at the extremes, so long as general relationships between color values are maintained. Interpolating between colorimetric and direct drive signal mappings maximizes use of the destination gamut without distorting local relationships. The third dimension (luminance) is not visualized, as it does not affect the mapping. Values that were clipped to the gamut boundary in sRGB will be clipped in the same way in the destination gamut; this is an intended consequence of the hybrid color mapping (HCM) method.

Figure 11:
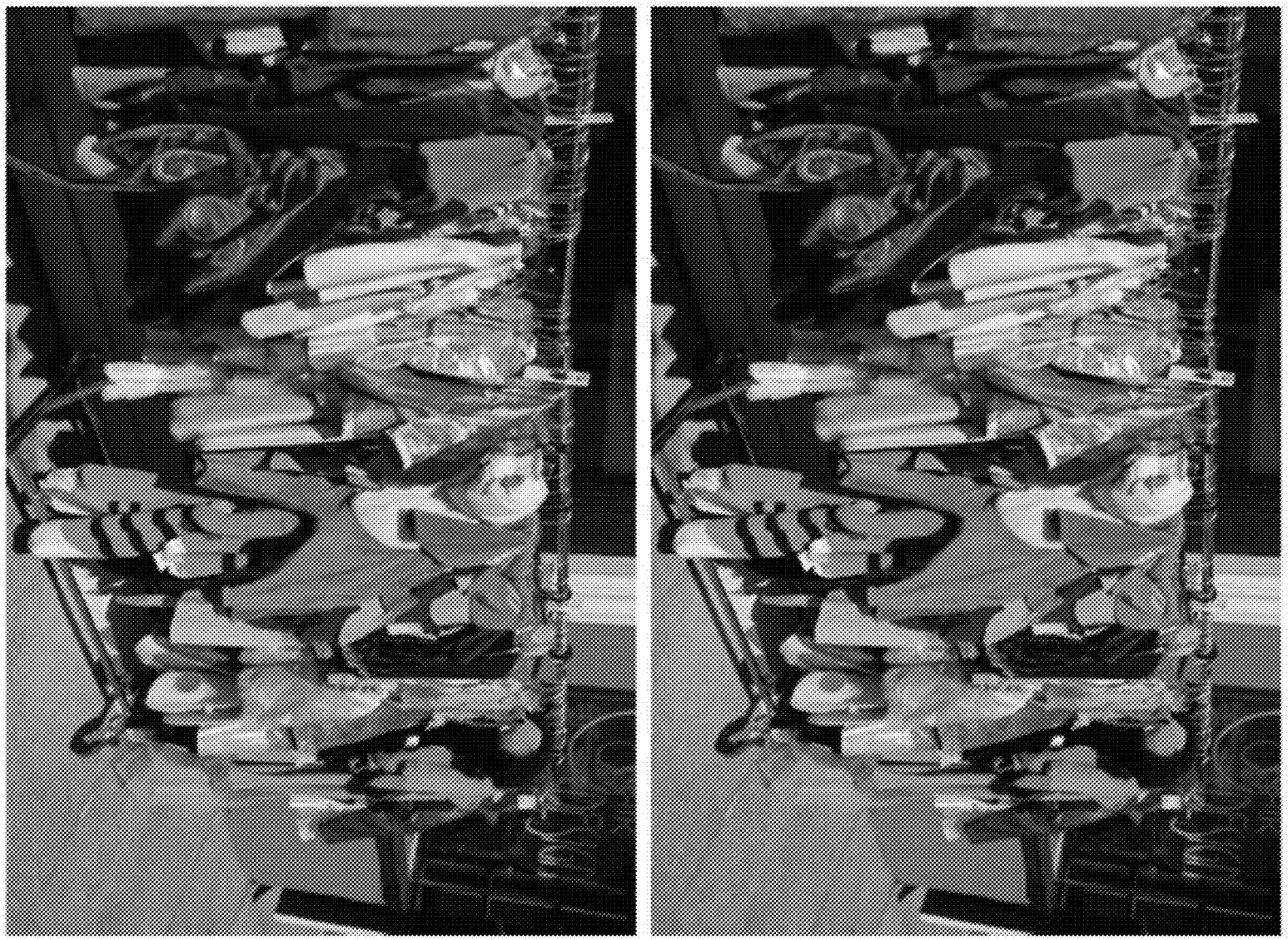
FIG. 11 illustrates examples image of an image in sRGB input (top) and the image white-balance and gamut-mapped using the example implementation described herein using laser display on bottom. Intense colors become more intense, and some shift slightly in hue, especially in deep blue where primaries do not align.

FIG. 11 shows (to the extent possible) the color shifts seen when expanding from a sRGB to laser primary color space using the example implementation. Unsaturated colors match between the original and the wide-gamut display device, while saturated colors become more saturated and may shift in hue towards the target device primaries.

Experimental Validation of Gamut-Mapping Implementation

The performance of gamut-mapping model of the experimental implementation was evaluated using the pairwise comparison approach introduced in [Eilertsen]. The experiment was set up in a dark room with a laser projector (PicoP by MicroVision Inc.) having a wide gamut color space shown in FIG. 10. 10 images processed by 3 different color models, the implemented HCM gamut mapping, colorimetric or true color mapping-TCM, and original image—SDS (same drive signal) were used. 20 naïve observers were asked to compare the presented result. Observers were asked to pick their preferred image of the pair. For each observer, total 30 pairs of images were displayed using the laser projector, 10 pairs for TCM:HCM, 10 pairs for HCM:SDS, and 10 pairs for SDS:TCM. The observers were instructed to select one of the two displayed images as their preferred image based on the overall feeling of the color and skin tones.

Observers consist of 7 females and 13 males from the age of 20 to 58. On average, the whole experiment took about 10 minutes for each observer.

Figure 12:
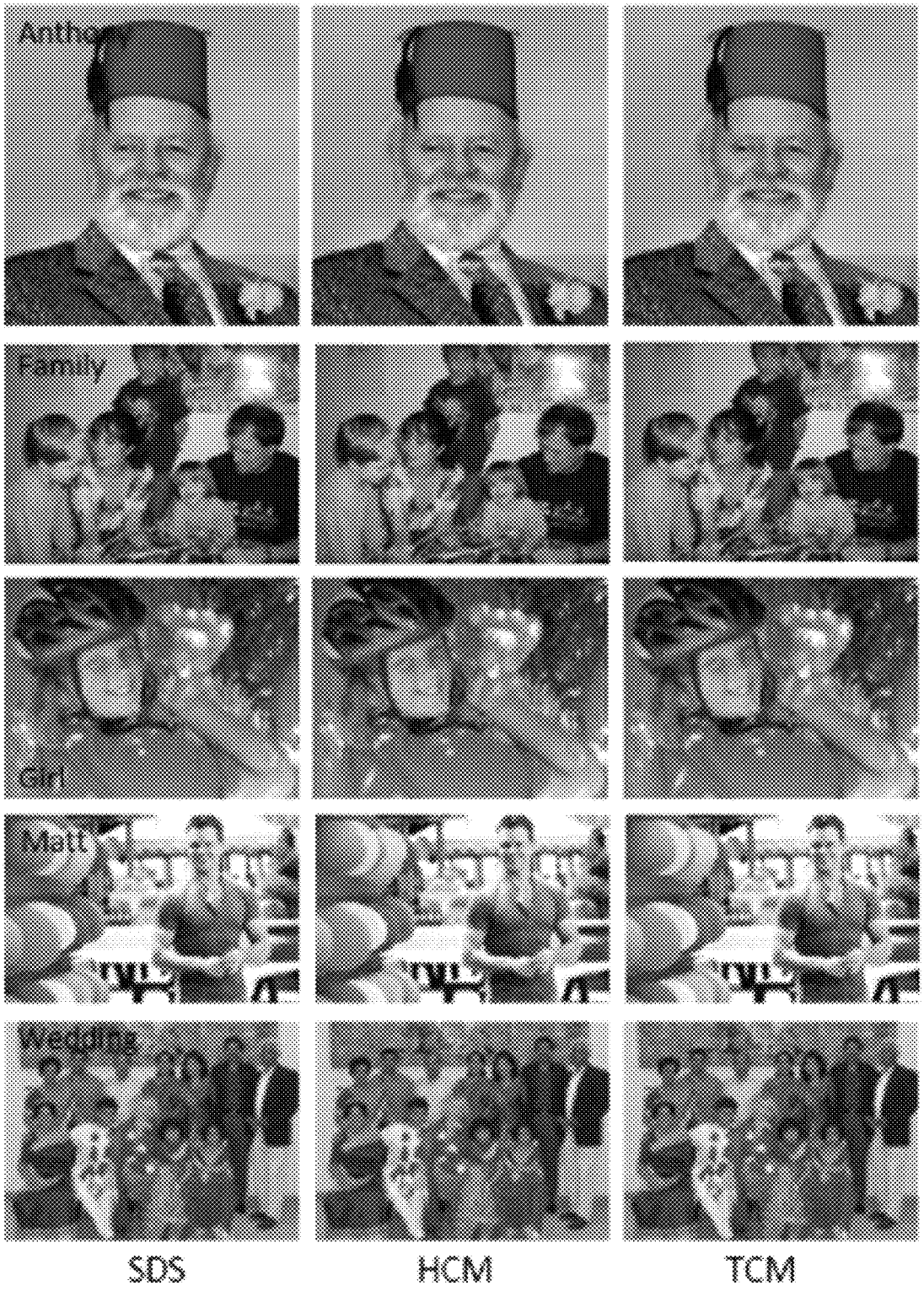
FIG. 12 illustrates Gamut mapping examples with original images and colorimetric reference: HCM—the example implementation described herein, SDS—original image, and TCM—colorimetric or true color mapping.

FIG. 12 shows gamut mapping results (HCM) with original images (SDS) and colorimetric mapping (TCM). A few of the images include well-known actors whose skin tones may be familiar to the observers. The example gamut mapping result keeps the face and skin color as in the colorimetric reference, but represents other areas more vividly, such as the colorful clothes in the image Wedding ($1_{st}$ row, left), the tiger balloon in the image Girl ($4_{th}$ row, right), and the red pant of a standing boy in the image Family ($5_{th}$ row, right).

The pairwise comparison method with just-noticeable difference (JND) evaluation was used in the experiment. This approach has been used recently for subjective evaluation in the literature [Eilertsen, Wanat, Mantiuk]. The Bayesian method of Silverstein and Farrell was used, which maximizes the probability that the pairwise comparison result accounts for the experiment under the Thurstone Case V assumptions. During an optimization procedure, a quality value for each image is calculated to maximize the probability, modeled by the binomial distribution. Since there are 3 conditions for comparison (HCM, TCM, SDS), this Bayesian approach is suitable, as it is robust to unanimous answers and common when a large number of conditions are compared.

Figure 13:
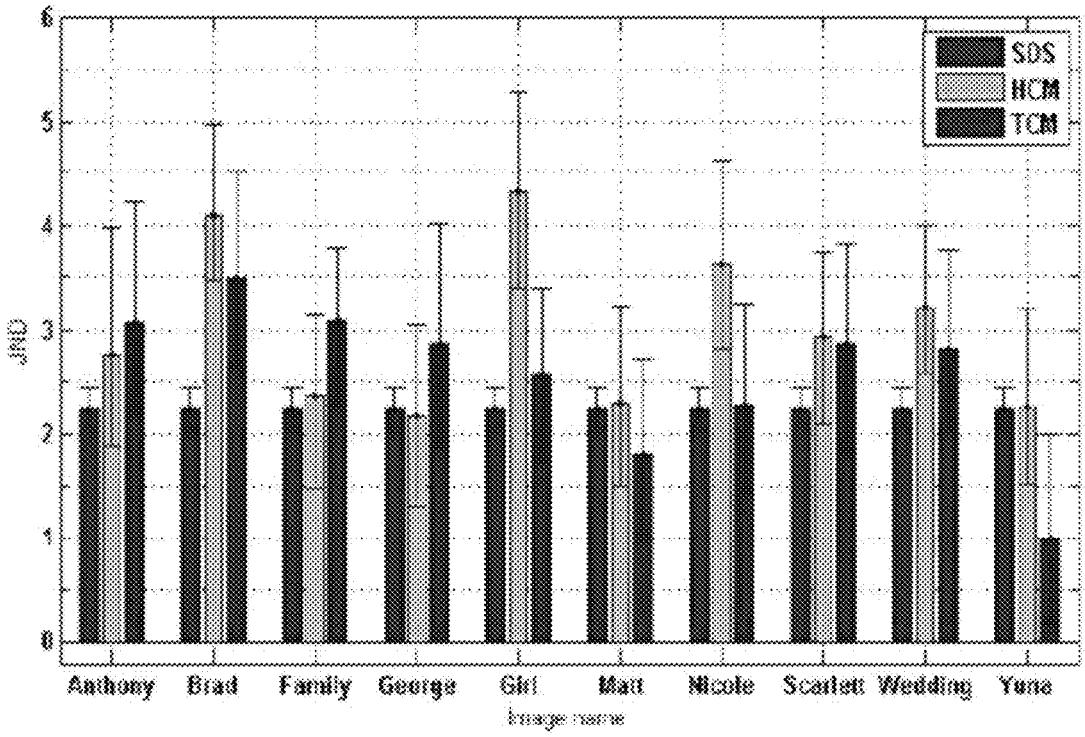
FIG. 13 illustrates a graph of Subjective evaluation results of pairwise comparison representing as JND values for each of 10 images including error bars which denote 95% confidence intervals calculated by bootstrapping—HCM: the example implementation described herein, SDS: original image, and TCM: colorimetric or true color mapping

FIG. 13 shows the result of the subjective evaluation calculating the JND values as defined in [Eilertsen]. The absolute JND values are not meaningful by themselves, since only relative difference can be used for discriminating choices. A method with higher JND is preferred over methods with smaller JND values, where 1 JND corresponds to 75% discrimination threshold. The FIG. 13 represents each JND value for each scene, rather than the average value, because JND is a relative value that can be also meaningful when compared with others. FIG. 13 represent the confidence intervals with 95% probability for each JND. To calculate the confidence intervals a numerical method was used, known as bootstrapping which allows estimation of the sampling distribution of almost any statistic using random sampling method [18]. 500 random sampling were used, then computed $2.5^{th}$ and $97.5^{th}$ percentiles for each JND point. The reason why JND values of SDS are same is that both JND and confidence intervals for JND are relative values. A reference point is needed to calculate them. SDS was chosen as the reference point. For 7 of the images, the example mapping is the most preferred method, with JND differences of 0.03~1.8 between it and the second most preferred method. For 3 of the images (Anthony, Family, George), HCM is not the most preferred method, losing by JND differences of 0.31~0.71.

Validation of Processing Graphical Content in the Context of Advertisement

A comparative advertisement campaign was carried out over the Facebook™ social networking platform in which two static advertisement banners were displayed on the Facebook™ platform. Each banner included a photograph of a human and some text. Each advertisement banner was displayed as originally created in some instances and was displayed in some instances after being processed to improve user perception. It was observed that for the first banner, the click-through rate for the unprocessed version was 1.85% while the click-through rate for the processed version was 2.92%. It was also observed that for the second banner, the click-through rate for the unprocessed version was 4.23% while the click-through rate for the processed version was 4.97%.

A second comparative advertisement campaign was carried out over Facebook™ social networking platform in which a 30 second video advertisement was displayed. It was observed that the click-through rate for the unprocessed version was 1.02% while the click-through rate for the processed version was 1.32%.

It will be appreciated that in both campaigns, processing the advertisement content resulted in a higher click-through rate versus the unprocessed version of the advertisement content.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

REFERENCES

[Fairchild & Wyble 2007] Mark D. Fairchild and David R. Wyble, "Mean Observer Metamerism and the Selection of Display Primaries," *Fifteenth Color Imaging Conference: Color Science and Engineering Systems, Technologies, and Applications*, Albuquerque, N. Mex.; November 2007.

[Fernandez & Fairchild 2002] S. Fernandez and M. D. Fairchild, "Observer preferences and cultural differences in color reproduction of scenic images," *IS&T/SID 10th Color Imaging Conference*, Scottsdale, 66-72 (2002).

[Langner et al. 2010] Oliver Langner, Dotsch, Ron, Bijlstra, Gijsbert, Wigboldus, Daniel H. J., Hawk, Skyler T. and van Knippenberg, Ad(2010) "Presentation and validation of the Radboud Faces Database," *Cognition & Emotion,* 24: 8 (2010).

[Morovic 2008] Jan Morovic, *Color Gamut Mapping*. Wiley (2008).

[Stockman & Sharpe 2006] A. Stockman and L. Sharpe, Physiologically-based colour matching functions, *Proc. ISCC/CIE Expert Symp. '06, CIE Pub.* x030:2006, 13-20 (2006).

Ján Moravič, *Color Gamut Mapping*, Wiley Publishing, 2008.

J. Laird, R. Muijs, J. Kuang, "Development and Evaluation of Gamut Extension Algorithms," *Color Research & Application,* 34:6 (2008).

G. Song, X. Meng, H. Li, Y. Han, "Skin Color Region Protect Algorithm for Color Gamut Extension," *Journal of Information & Computational Science,* 11:6 (2014), pp. 1909-1916.

S. W. Zamir, J. Vazquez-Corral, M. Bertalmío, "Gamut Extension for Cinema: Psychophysical Evaluation of the State of the Art, and a New Algorithm," *Proc. SPIE Human Vison and Electronic Imaging XX,* 2015.

S. W. Zamir, J. Vazquez-Corral, M. Bertalmio, "Gamut Mapping in Cinematography Through Perceptually-Based Contrast Modification," *IEEE Journal of Selected Topics in Signal Processing,* 8:3, June 2014.

J. Vazquez-Corral, M. Bertalmío, "Perceptually inspired gamut mapping between any gamuts with any intersection," *AIC Midterm Meeting,* 2015.

G. Eilertsen, R. Wanat, R. K. Mantiuk, and J. Unger, "Evaluation of tone mapping operators for hdr-video," Computer Graphics Forum, vol. 32, no. 7, pp. 275-284, Wiley Online Library, 2013.

R. Wanat, and R. K. Mantiuk, "Simulating and compensating changes in appearance between day and night vision," ACM Trans. Graph., vol. 33, no. 4, 147-1, 2014.

M. Rezagholizadeh, T. Akhavan, A. Soudi, H. Kaufmann, and J. J. Clark, "A Retargeting Approach for Mesopic Vision: Simulation and Compensation," Journal of Imaging Science and Technology, 2015.

D. A. Silverstein, and J. E. Farrell, "Efficient method for paired comparison," Journal of Electronic Imaging, vol. 10, no. 2, pp. 394-398, 2001.

Getty Images, Image-Anthony, from http://www.gettyimages.ca/detail/news-photo/anthony-hopkinswearing-a-red-fez-unveils-a-statue-of-tommy-news-photo/79953291.

Associated Newspapers Ltd, Aug. 28, 2008, Image-Brad, from http://www.dailymail.co.uk/tvshowbiz/article-1050071/Brad-Pittsshining-moment-Venice-interrupted-hes-asked-present-gift-George-Clooney.html#ixzz453n84rM6.

NAVER Corp., Image-George, from http://movie.naver.com/movie/bi/mi/photoView.nhn?code=81834&imageNid=6261978

FANPOP, Inc., Image-Yuna, from http://www.fanpop.com/clubs/yunakim/images/9910994/title/scheherazade-yuna-kim-08-09-season-freeskating-long-program-photo.

Emma, Apr. 21, 2012, Image-Scarlett, from http://vivanorada.blogspot.ca/2012/04/you-got-style-scarlettjohansson.html Just Jared Inc., Jul. 13, 2011, Image-Nicole, from http://www.justjared.com/photo-gallery/2560483/nicole-kidmankeith-urban-snow-flower-06/#ixzz453u8IJIE Bett Watts, Dec. 13, 2011, Image-Matt, from http://www.gg.com/story/matt-damon-gg-january-2012-cover-storyarticle.

H. Varian, "Bootstrap tutorial," Mathematica Journal, vol. 9, no. 4, pp. 768-775, 2005.

The invention claimed is:

1. A method for processing an input image for display on a wide-gamut display device, the method comprising:

receiving an age-related characteristic of a user viewing the wide-gamut display device;

receiving a color-temperature setting of the user;

determining a set of color scaling factors based on the age-related characteristic of the user, the color-temperature setting of the user and a gamut of the wide-gamut display device;

applying gamut expansion to the input image to generate a gamut-expanded image;

applying the set of color scaling factors to the gamut expanded image to adjust a white point thereof;

wherein determining the set of color scaling factors comprises:

determining a black body spectrum corresponding to the received color-temperature setting;

determining a first set of LMS cone responses corresponding to the black body spectrum based on the age-related characteristic of the user;

determining a second set of LMS cone responses based on a primary spectra of the wide gamut display device; and determining the set of color scaling factors providing a correspondence between the first set of LMS cone responses and the second set of LMS cone responses.

2. The method of claim 1, wherein the age-related characteristic of the user is received from a user-entered parameter denoting an effective age of the user.

3. The method of claim 2, wherein the user-entered parameter is entered from the user interacting with a slider, the slider being representative of the effective age without explicitly displaying the effective age.

4. The method of claim 1, wherein the age-related characteristic is received from a third party providing age-related information to the user.

5. The method of claim 1, wherein determining the set of color scaling factors further comprises:

balancing the primary spectra of the wide gamut display device according to a current white point of the wide gamut display device; and wherein the first set of LMS cone responses is determined based on the balanced primary spectra of the wide gamut display device.

6. The method of claim 5, wherein the first set of LMS cone responses is further determined based on an age-based physiological model of viewer cone responses.

7. A computer-implemented system for processing an input image for display on a wide-gamut display device, the system comprising:

at least one data storage device; and at least one processor operably coupled to the at least one storage device, the at least one processor being configured for:

receiving an age-related characteristic of a user viewing the wide- gamut display device;

receiving a color-temperature setting of the user;

determining a set of color scaling factors based on the age-related characteristic of the user, the color-temperature setting of the user and a gamut of the wide-gamut display device;

applying gamut expansion to the input image to generate a gamut- expanded image; and applying the set of color scaling factors to the gamut expanded image to adjust a white point thereof;

wherein determining the set of color scaling factors comprises:

determining a black body spectrum corresponding to the received color-temperature setting;

determining a first set of LMS cone responses corresponding to the black body spectrum based on the age-related characteristic of the user.

determining a second set of LMS cone responses based on a primary spectra of the wide gamut display device; and determining the set of color scaling factors providing a correspondence between the first set of LMS cone responses and the second set of LMS cone responses.

8. The system of claim 7, wherein the age-related characteristic of the user is received from a user-entered parameter denoting an effective age of the user.

9. The system of claim 8, wherein the user-entered parameter is entered from the user interacting with a slider, the slider being representative of the effective age without explicitly displaying the effective age.

10. The system of claim 7, wherein the age-related characteristic is received from a third party providing age-related information to the user.

11. The system of claim 7, wherein determining the set of color scaling factors further comprises:

balancing the primary spectra of the wide gamut display device according to a current white point of the wide gamut display device; and wherein the first set of LMS cone responses is determined based on the balanced primary spectra of the wide gamut display device.

12. The system of claim 11, wherein the first set of LMS cone responses is further determined based on an age-based physiological model of viewer cone responses.

13. A method for processing an input image for display on a wide-gamut display device, the method comprising:

receiving an age-related characteristic of a user viewing the wide-gamut display device;

determining a set of color scaling factors based on the age-related characteristic of the user and a gamut of the wide-gamut display device;

applying gamut expansion to the input image to generate a gamut-expanded image; and applying the set of color scaling factors to the gamut expanded image to adjust a white point thereof;

wherein the input image is represented in a first color space and the wide-gamut display device is configured to display images in a second color space;

wherein the gamut expansion comprises, for each image pixel of a plurality of pixels of the input image:

converting color value components of the image pixel in the first color space to a corresponding set of chromaticity coordinates in a chromaticity coordinate space;

defining a sacred region within the chromaticity coordinate space;

determining whether the set of chromaticity coordinates of the image pixel is located within the sacred region; and determining a set of mapped color value components of the image pixel based on:

if the chromaticity coordinates of the image pixel is located within the sacred region, applying a first mapping of the color value components of the image pixel; and if the chromaticity coordinates of the image pixel is located outside the sacred region, applying a second mapping of the color value components of the image pixel;

converting the color value components of the image pixel to a corresponding set of color value components in the second color space;

wherein if the chromaticity coordinates of the image pixel is located within the sacred region, applying the first mapping to set the corresponding set of color value components in the second color space as the gamut-mapped color value components for the given pixel;

wherein if the chromaticity coordinates of the image pixel is located outside the sacred region, applying the second mapping based on:

i) a distance between the chromaticity coordinates of the image pixel and an edge of the sacred region; and ii) a distance between the chromaticity coordinates of the image pixel and an outer boundary of the second color space defining the spectrum of the wide gamut display device.

14. The method of claim 13, wherein applying the second mapping comprises applying a linear interpolation between the color value components of the image pixel in the first color space and the color value components of the image pixel in the second color space.

15. The method of claim 13, wherein the sacred color region comprises one or more of neutral colors, earth tones and flesh tones.

16. The method of claim 13, wherein the age-related characteristic of the user is received from a user-entered parameter denoting an effective age of the user, the user-entered parameter being entered from the user interacting with a slider, the slider being representative of the effective age without explicitly displaying the effective age.

17. The method of claim 13, wherein the age-related characteristic is received from a third party providing age-related information to the user.

18. A computer-implemented system for processing an input image represented in a first color space for display on a wide-gamut display device configured to display images in a second color space, the system comprising:

at least one data storage device: and at least one processor operably coupled to the at least one storage device, the at least one processor being configured for:

receiving an age-related characteristic of a user viewing the wide-gamut display device:

determining a set of color scaling factors based on the age-related characteristic of the user and a gamut of the wide-gamut display device;

applying gamut expansion to the input image to generate a gamut-expanded image; and applying the set of color scaling factors to the gamut expanded image to adjust a. white point thereof;

wherein the gamut expansion comprises, for each image pixel of a plurality of pixels of the input image:

converting color value components of the image pixel in the first color space to a corresponding set of chromaticity coordinates in a chromaticity coordinate space;

defining a sacred region within the chromaticity coordinate space; determining whether the set of chromaticity coordinates of the image pixel is located within the sacred region; and determining a set of mapped color value components of the image pixel based on:

if the chromaticity coordinates of the image pixel is located within the sacred region, applying a first mapping of the color value components of the image pixel; and if the chromaticity coordinates of the image pixel is located outside the sacred region, applying a second mapping of the color value components of the image pixel; converting the color value components of the image pixel to a corresponding set of color value components in the second color space;

wherein if the chromaticity coordinates of the image pixel is located within the sacred region, applying the first mapping to set the corresponding set of color value components in the second color space as the gamut-mapped color value components for the given pixel; and wherein if the chromaticity coordinates of the image pixel is located outside the sacred region, applying the second mapping based on:

i) a distance between the chromaticity coordinates of the image pixel and an edge of the sacred region; and ii) a distance between the chromaticity coordinates of the image pixel and an outer boundary of the second color space defining the spectrum of the wide, gamut display device.

19. The system of claim 18, wherein applying the second mapping comprises applying a linear interpolation between the color value components of the image pixel in the first color space and the color value components of the image pixel in the second color space.

20. The system of claim 18, wherein the sacred color region comprises one or more of neutral colors, earth tones and flesh tones.

21. The system of claim 18, wherein the age-related characteristic of the user is received from a user-entered parameter denoting an effective age of the user, the user-entered parameter being entered from the user interacting with a slider, the slider being representative of the effective age without explicitly displaying the effective age.

22. The system of claim 18, wherein the age-related characteristic is received from a third party providing age-related information to the user.

* * * * *